US011849755B2

(12) United States Patent
Liu et al.

(10) Patent No.: US 11,849,755 B2
(45) Date of Patent: Dec. 26, 2023

(54) STEM SCREENING AND CONDITIONING DEVICE AND METHOD OF USING THE SAME

(71) Applicant: CHINA TOBACCO YUNNAN INDUSTRIAL CO., LTD, Kunming (CN)

(72) Inventors: Ze Liu, Kunming (CN); Zeyu Wang, Kunming (CN); Yuanzhen Zhou, Kunming (CN); Xuefeng Zhu, Kunming (CN); Tiansheng Dai, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 0 days.

(21) Appl. No.: 17/925,016

(22) PCT Filed: Jun. 6, 2022

(86) PCT No.: PCT/CN2022/097152
§ 371 (c)(1),
(2) Date: Nov. 14, 2022

(87) PCT Pub. No.: WO2022/257888
PCT Pub. Date: Dec. 15, 2022

(65) Prior Publication Data

US 2023/0189868 A1 Jun. 22, 2023

(30) Foreign Application Priority Data

Jun. 9, 2021 (CN) ..... 202110644655.2

(51) Int. Cl.
*A24B 5/16* (2006.01)
*A24B 3/12* (2006.01)
(Continued)

(52) U.S. Cl.
CPC ..... *A24B 5/16* (2013.01); *A24B 3/12* (2013.01); *B07B 1/18* (2013.01); *B07B 1/469* (2013.01); *B08B 5/02* (2013.01)

(58) Field of Classification Search
CPC ..... B07B 1/469; B07B 1/18; B08B 5/02
See application file for complete search history.

(56) References Cited

U.S. PATENT DOCUMENTS 5,628,126 A 5/1997 North
5,676,164 A 10/1997 Martin
6,305,552 B1 * 10/2001 Coleman ..... B07B 1/24 209/664

FOREIGN PATENT DOCUMENTS

CN 104621700 A 5/2015
CN 108212735 A 6/2018
(Continued)

*Primary Examiner* — Michael H. Wilson
*Assistant Examiner* — Jennifer A Kessie
(74) *Attorney, Agent, or Firm* — Bayramoglu Law Offices LLC

(57) ABSTRACT

A stem screening and conditioning device includes a roller, a thermal insulation cover, a spiral feeding device, a compressed-air cleaning device, a steam tube, a discharge hole, and a waste hole. A stem screening and conditioning method for the stem screening and conditioning device is also provided. The present disclosure realizes the complete separation of normal-size and undersized stems under the premise of full moisture absorption, thereby improving the refinement and homogenization level of stem conditioning.

18 Claims, 2 Drawing Sheets

(51) Int. Cl.

| | |
|---|---|
| ***B07B 1/18*** | (2006.01) |
| ***B07B 1/46*** | (2006.01) |
| ***B08B 5/02*** | (2006.01) |

(56) References Cited

FOREIGN PATENT DOCUMENTS

| | | | |
|---|---|---|---|
| CN | 109393538 | A | 3/2019 |
| CN | 111774280 | A | 10/2020 |
| CN | 113273712 | A | 8/2021 |
| GB | 932179 | A | 7/1963 |

* cited by examiner

STEM SCREENING AND CONDITIONING DEVICE AND METHOD OF USING THE SAME

CROSS REFERENCE TO THE RELATED APPLICATIONS

This application is the national phase entry of International Application No. PCT/CN2022/097152, filed on Jun. 6, 2022, which is based upon and claims priority to Chinese Patent Application No. 202110644655.2, filed on Jun. 9, 2021, the entire contents of which are incorporated herein by reference.

TECHNICAL FIELD

The present disclosure belongs to the field of tobacco processing machinery and, in particular, relates to a stem screening and conditioning device and method of using the same.

BACKGROUND

During the processing of tobaccos, the pretreatment of tobacco stems is an important task and mainly relies on steam and water to increase the moisture and temperature of stems. Stem conditioning can effectively increase the moisture and temperature of stems and enhance the pliability and degradation resistance of the stems, thereby facilitating subsequent processing.

Four factors of the pretreatment of tobacco stems are water amount, temperature, pressure, and storage time. The amount of water added determines the final moisture of the stems and is the basis for moisture penetration. The control of temperature and pressure is critical to the moisture absorption of stems to increase the penetration rate and promote the transformation of chemical components in the stems. The storage time is a key factor to make stems fully penetrated. Therefore, the design of a stem conditioning device needs to comprehensively consider temperature, pressure, and time. High temperature and pressure can shorten the time of treatment; in contrast, low temperature and pressure increase the time. In addition, the time of treatment can be increased to reduce steam consumption in production, and the temperature and pressure of treatment can be increased to compensate for insufficient time of treatment. If stems are fully conditioned in the treatment, the storage time of stems can be shortened and the process flow can be simplified, thereby reducing the investment in the stem treatment system and reducing the energy consumption of steam.

The traditional stem conditioning device makes steam or atomized water contact with stems to increase the moisture and temperature of stems to improve the moisture penetration effect. The high-temperature treatment can promote the browning of stems and degrade cell wall materials, such as lignin, cellulose, and pectin. However, the existing stem conditioning devices have the following common defects. 1. The stem conditioning device suffers from high steam consumption, low steam utilization, large steam overflow and exhaust discharge, and large steam heat loss, making it the top steam-consuming device in the stem preparation line. 2. The moistening time is insufficient, that is, the contact time between stems and steam is short, the moisture penetration effect varies greatly in different stems, and stems are easily broken in the subsequent flattening process. 3. The moisture penetration effect also varies due to different sizes and aging quality of the stems. Although short and fine stems can be penetrated, they easily remain uncut and missed in the subsequent cutting process, resulting in a large number of slivers. As a result, the number of slivers to be removed in the subsequent separation process is significantly increased, and there will be excessively short and scrap stems in the finished stems.

The present disclosure is proposed to solve the above-mentioned problems.

SUMMARY

To solve the above problems, the present disclosure provides a stem screening and conditioning device. The present disclosure conveys the stems through a roller with an inner spiral blade and lifting blades. By reasonably designing the roller length, roller speed, and reverse steam inflow, the present disclosure extends the stem conditioning time, realizes full moisture adsorption of the stem, and reduces the energy consumption and exhaust discharge. Meanwhile, the present disclosure provides screen holes in a roller wall to realize the full separation of undersize stems such as short, fine, and scrap stems. Therefore, the present disclosure improves the refinement and homogenization level of stem conditioning.

To achieve the above objective, the present disclosure adopts the following technical solutions.

A first aspect of the present disclosure provides a stem screening and conditioning device, which includes:

- a roller which is provided horizontally in an axial direction, wherein a wall of the roller is provided with screen holes, the roller is provided with an open upper end and an open bottom end, the roller rotates around the axial direction, the open upper end of the roller is provided with a driving motor and a driving support wheel, and the open bottom end is provided with a driven support wheel;
- a thermal insulation cover being roughly cylindrical and sleeved at the periphery of the roller in a sealed manner, wherein the thermal insulation cover is stationary;
- a spiral feeding device which enters from an upper end of the thermal insulation cover into the open upper end of the roller;
- a compressed-air cleaning device which includes a blowing tube and a compressed-air tank, wherein blowing tube enters from a bottom end of the thermal insulation cover into the roller;
- a steam tube which enters from the bottom end of the thermal insulation cover into the roller;
- a discharge hole provided at the open bottom end of the roller; and
- a waste hole provided on an outer wall of the bottom end of the thermal insulation cover.

The discharge hole and the waste hole each are provided with an airlock to prevent steam from overflowing during an unloading process and to regulate moisture discharge and pressure in the roller and the thermal insulation cover.

Preferably, an inner wall of the roller is provided with an inner spiral blade in the axial direction. An angle between the inner spiral blade and the inner wall of the roller is 30°-60°. A small angle between the inner spiral blade and the inner wall of the roller leads to a larger lifting height of stems.

Preferably, the inner wall of the roller is provided with multiple lifting blades, which are arranged in the axial direction and perpendicular to the inner wall of the roller.

The size and shape of the lifting blades and the layout of the lifting blades on the inner wall of the roller are designed as required.

Preferably, the outer wall of the roller is provided with an outer spiral blade in the axial direction. The outer spiral blade is perpendicular to the outer wall of the roller. The width of the outer spiral blade is roughly equal to the length of a gap between the outer wall of the roller and an inner wall of the thermal insulation cover, that is, the width of the outer spiral blade is close to the difference in radii of the roller and the thermal insulation cover, which are concentric with each other.

Preferably, the spiral feeding device includes a cylindrical shell and a spiral propeller inside the cylindrical shell. The cylindrical shell has a front upper portion provided with an opening for receiving stems and a rear lower portion provided with an opening for conveying the stems into the roller.

Preferably, the blowing tube is provided above an axis of the roller and close to the inner wall of the roller. The blowing tube has an upper end surface provided with multiple evenly distributed compressed-air nozzles.

Preferably, the steam tube has a lower end surface provided with multiple evenly distributed steam nozzles. The steam is concentrated at central and lower portions of the roller, thereby increasing the contact area and contact time between the stems and the steam and facilitating rapid conditioning of the stems.

Preferably, the roller has a length of 6 m-12 m. The length of the roller can be set as required.

Preferably, each of the screen holes has a diameter of 3.8 mm, and the spacing between the screen holes is 45 mm. The screen holes can adopt other diameters and spacing as required.

A second aspect of the present disclosure provides a stem screening and conditioning method for the stem screening and conditioning device, which includes the following steps:

turning on the stem screening and conditioning device; rotating the roller around the axial direction; feeding, by the spiral feeding device, the stems into the roller; spraying, by the steam tube, steam onto the stems in the roller; allowing normal-size stems to be conveyed forward by the rotational actions of the inner spiral blade and the lifting blades and to be lifted by the lifting blades for a fully contact with the steam, and being transferred to a rear end of the roller and discharged from the discharge hole to complete conditioning; allowing undersized stems to pass the screen holes of the roller, enter the gap between the outer wall of the roller and the inner wall of the thermal insulation cover, be conveyed forward under a push action of the outer spiral blade, and be discharged from the waste hole; and after completing the screening and conditioning of the stems, blowing the screen holes in the inner wall of the roller by the compressed-air nozzles of the blowing tube for a real-time cleaning for a real-time cleaning to ensure that the screen holes are smooth.

The present disclosure has the following beneficial effects:

1. The present disclosure realizes the screening and conditioning processes of the stems at the same time.
2. The present disclosure reasonably designs the length of the roller, the reverse entry of the steam, and the action mode of the steam blowing toward the stems, and adopts the stem conveying mode that combines the inner spiral blades with multiple lifting blades. In this way, the present disclosure ensures that the stems fully contact the steam when they are lifted, which improves the moistening effect of the stems, prolongs the screening and conditioning time of the stems, and enables the stems to fully absorb the steam. Meanwhile, the airlocks of the spiral feeding device and the discharge hole reduce the energy consumption and exhaust discharge of stem treatment, thereby effectively reducing the energy loss and greatly improving steam utilization.
3. The present disclosure realizes the complete separation of normal-size and undersized stems, and thus, improves the refinement and homogenization level of stem conditioning. The present disclosure further increases the contact area and contact time of the stems and the steam through a compressed-air cleaning device, thereby promoting the conditioning of the stems.

Figure 1:
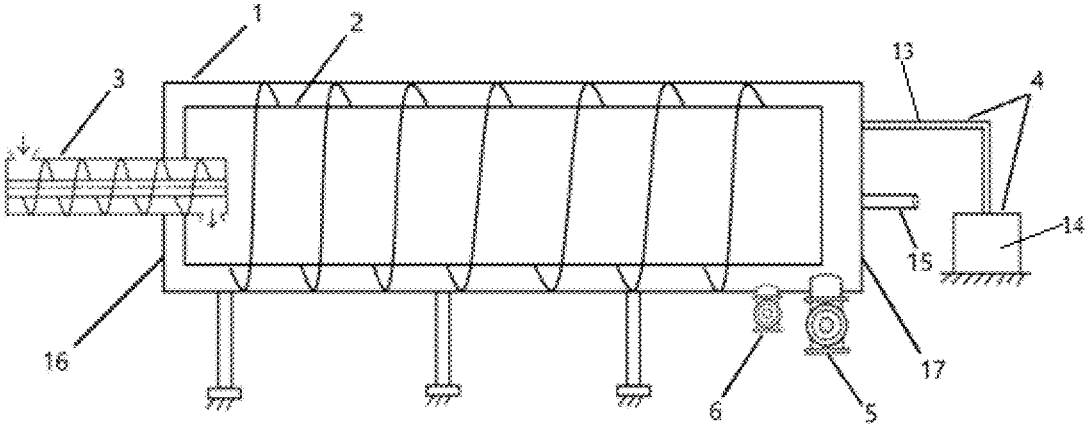
FIG. 1 is a structural view of a stem screening and conditioning device according to the present disclosure.
Figure 2:
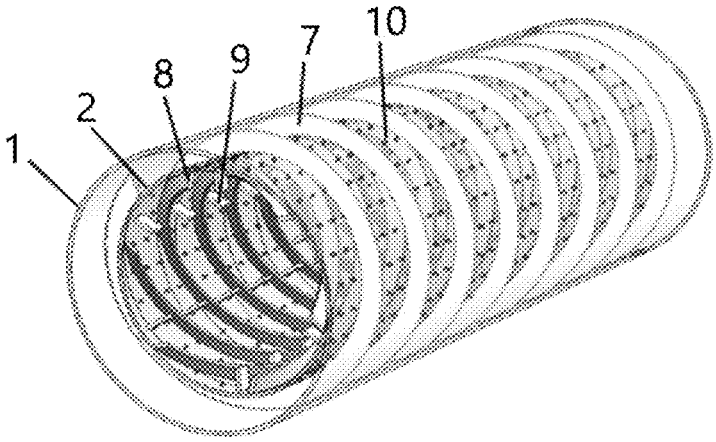
FIG. 2 is a stereoscopic view of a roller of the stem screening and conditioning device according to the present disclosure.
Figure 3:
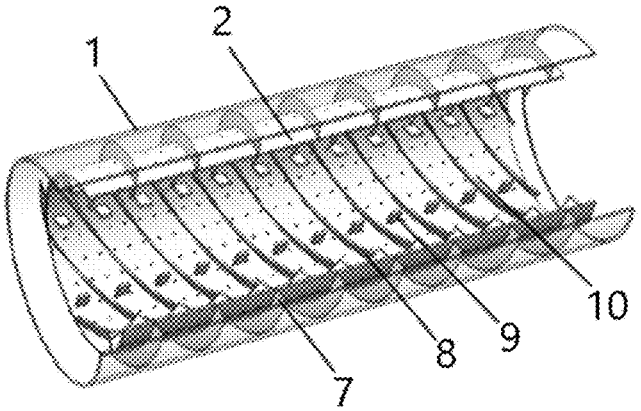
FIG. 3 is a sectional view of the roller of the stem screening and conditioning device according to the present disclosure.
Figure 4:
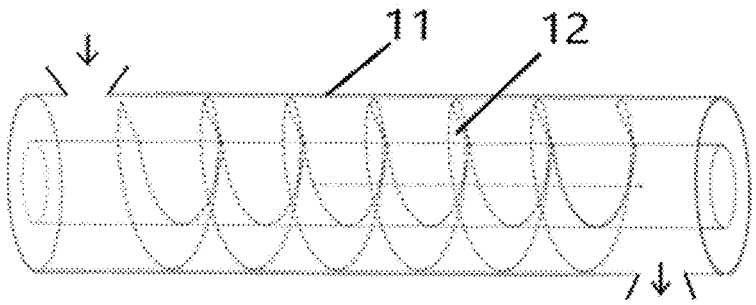
FIG. 4 is a structural view of a spiral feeding device of the stem screening and conditioning device according to the present disclosure.
Figure 5:
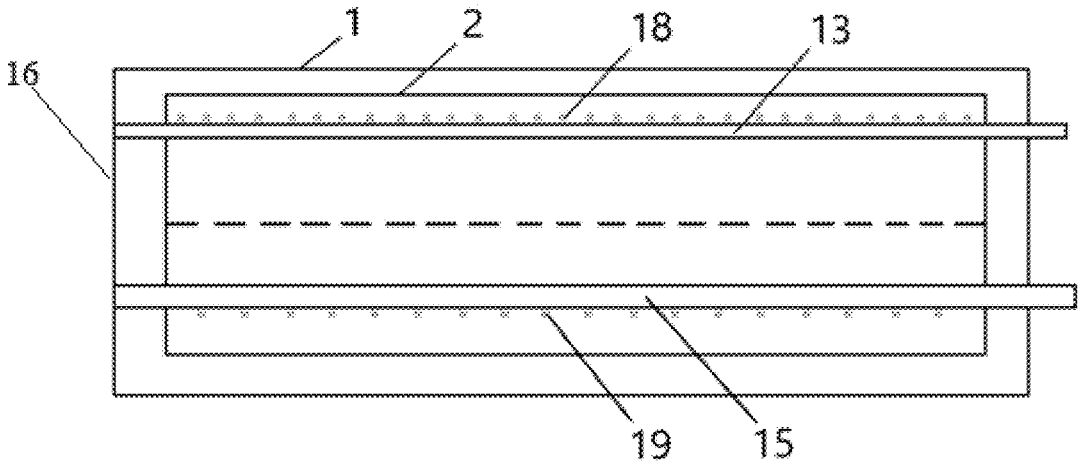
FIG. 5 is a structural view of a blowing tube and a steam tube of the stem screening and conditioning device according to the present disclosure.

Reference Numerals: 1. thermal insulation cover; 2. roller; 3. spiral feeding device; 4. compressed-air cleaning device; 5. discharge hole; 6. waste hole; 7. outer spiral blade; 8. inner spiral blade; 9. lifting blade; 10. screen hole; 11. cylindrical shell; 12. spiral propeller; 13. blowing tube; 14. compressed-air tank; 15. steam tube; 16. entrance panel; 17. exit panel; 18. compressed-air nozzle; and 19. steam nozzle.

DETAILED DESCRIPTION OF THE EMBODIMENTS

To make the objective, technical solutions, and beneficial effects of the present disclosure clear, the preferred embodiments of the present disclosure will be described in detail below.

As shown in FIG. 1, a stem screening and conditioning device includes two concentric cylinders having different diameters stacked together. A cylinder with a smaller diameter is roller 2. The roller 2 includes a wall provided with screen holes 10. The roller is provided with an open upper end and an open bottom end. The open upper end of the roller 2 is provided with a driving motor and a driving support wheel (not shown in the figures), and the open bottom end is provided with a driven support wheel (not shown in the figures). A cylinder with a larger diameter is thermal insulation cover 1. The thermal insulation cover 1 has an upper end sealed and a bottom end provided with an open access door. The roller 2 is rotatable around the axial direction, while the thermal insulation cover 1 is stationary.

The stem screening and conditioning device further includes spiral feeding device 3. The spiral feeding device 3 includes cylindrical shell 11 and spiral propeller 12 provided in the cylindrical shell. The cylindrical shell 11 has a front opening for receiving stems and a rear opening for conveying the stems into the roller 2. The spiral feeding device 3 is horizontally provided in the axial direction and enters from an upper end of the thermal insulation cover 1 into the roller 2.

The stem screening and conditioning device further includes compressed-air cleaning device 4. The compressed-air cleaning device 4 includes blowing tube 13 and compressed-air tank 14. The blowing tube 13 enters from a bottom end of the thermal insulation cover 1, runs through the inside the roller 2, and is connected to panel 16 at the upper end of the thermal insulation cover 1. The blowing tube is located above the axis of the roller 2 and close to the inner wall of the roller 2. The blowing tube has one end connected to the panel 16 in a sealed manner and the other end connected to panel 17 at the bottom end of the thermal insulation cover 1 is in communication with the compressed-air tank 14 outside. The steam tube 15 enters from the bottom end of the thermal insulation cover 1, runs through the inside the roller 2, and connects to the panel 16 at the upper end of the thermal insulation cover 1.

The stem screening and conditioning device further includes discharge hole 5, which is located at the rear end of each of the two concentric cylinders and is provided at a lower portion of the open bottom end of the roller 2.

The stem screening and conditioning device further includes waste hole 6, which is located at the rear end of each of the two concentric cylinders and on a wall of the thermal insulation cover 1. The discharge hole 5 and the waste hole 6 each are provided with an airlock to prevent steam from overflowing during an unloading process and to regulate moisture discharge and pressure in the roller and the thermal insulation cover.

In this embodiment, the roller 2 is provided horizontally in the axial direction, which prolongs the residence time of the stems in the roller 2.

In this embodiment, the screen holes 10 have a diameter of 3.8 mm and a spacing of 45 mm, and the roller 2 has a length of 6 m.

In this embodiment, the blowing tube 13 is provided with 20 evenly arranged compressed-air nozzles 18 along the axial direction so that the screen holes 10 in the inner wall of the roller 2 are blown in a real-time manner during the screening and conditioning process. The design ensures that the screen holes 10 are clean, and blowing the upper portion of the roller 2 makes stream enriched in the central and lower portions of the roller, thereby increasing the contact time and contact surface between the stems and the steam and promoting the conditioning of the stems.

In this embodiment, the steam tube 15 is provided with 10 evenly arranged downward steam nozzles 19 along the axial direction to evenly apply the steam to the stems in the roller 2 during the screening and conditioning process.

In this embodiment, the inner wall of the roller 2 is provided with inner spiral blade 8 in the axial direction. The inner spiral blade 8 forms an angle of 60° with the axial direction of the inner wall of the roller 2, and the inner spiral blade 8 is configured to convey the stems.

In this embodiment, the inner wall of the roller 2 is provided with multiple lifting blades 9, which are arranged in the axial direction and perpendicular to the inner wall of the roller 2. The size and shape of the lifting blades 9, as well as the layout of the lifting blades 9 on the inner wall of the roller 2, are designed according to the requirements of stem screening and conditioning.

In this embodiment, the outer wall of the roller 2 is provided with outer spiral blade 7 in the axial direction. The outer spiral blade 7 is perpendicular to the outer wall of the roller 2. The width of the outer spiral blade 7 is close to the difference in radii of the roller and the thermal insulation cover which are concentric with each other. The outer spiral blade 7 is configured to convey broken stems that are screened out to the waste hole 6.

A stem screening and conditioning method for the stem screening and conditioning device includes the following steps:

The stem screening and conditioning device is turned on. The roller 2 is rotated around the axial direction, and the spiral feeding device 3 feeds the stems into the roller 2. The steam tube 15 sprays the steam onto the stems in the roller 2. Normal-size stems are conveyed forward by the rotational actions of the inner spiral blade 8 and the lifting blades 9 and to be lifted by the lifting blades 9 for a fully contact the steam, and being transferred to a rear end of the roller 2 and discharged from the discharge hole 5 to complete conditioning. Undersized stems pass the screen holes 10 of the roller 2, enter the gap between the outer wall of the roller 2 and the inner wall of the thermal insulation cover 1, are conveyed forward under a push action of the outer spiral blade 7, and be discharged from the waste hole 6. After the screening and conditioning of the stems is complete, the compressed-air nozzles 18 of the blowing tube 13 blow compressed air at the screen holes 10 in the inner wall of the roller 2 for a real time cleaning to ensure that the screen holes 10 are smooth while the steam is concentrated at the central and lower portions of the roller 2, which facilitates rapid conditioning of the stems.

The above preferred embodiments are only intended to illustrate the technical solutions of the present disclosure, rather than to limit them. Although the present disclosure is described in detail by referring to the above preferred embodiments, those skilled in the art should appreciate that various changes may be made to the present disclosure in form and detail without departing from the protection scope of the present disclosure.

What is claimed is:

1. A stem screening and conditioning device comprising:

a roller provided horizontally in an axial direction, wherein a wall of the roller is provided with screen holes, the roller is provided with an open upper end and an open bottom end, and the roller rotates around the axial direction;

a thermal insulation cover being roughly cylindrical and sleeved at a periphery of the roller in a sealed manner;

a spiral feeding device entering from an upper end of the thermal insulation cover into the open upper end of the roller;

a compressed-air cleaning device comprising a blowing tube and a compressed-air tank, wherein the blowing tube enters from a bottom end of the thermal insulation cover into the roller;

a steam tube entering from the bottom end of the thermal insulation cover into the roller;

a discharge hole provided at the open bottom end of the roller; and a waste hole provided on an outer wall of the bottom end of the thermal insulation cover.

2. The stem screening and conditioning device according to claim 1, wherein an inner wall of the roller is provided with an inner spiral blade in the axial direction.

3. The stem screening and conditioning device according to claim 1, wherein an inner wall of the roller is provided with multiple lifting blades, and the multiple lifting blades are arranged in the axial direction and perpendicular to the inner wall of the roller.

4. The stem screening and conditioning device according to claim 1, wherein an outer wall of the roller is provided with an outer spiral blade in the axial direction, and the outer spiral blade is perpendicular to the outer wall of the roller; and a width of the outer spiral blade is roughly equal to a length of a gap between the outer wall of the roller and an inner wall of the thermal insulation cover.

5. The stem screening and conditioning device according to claim 1, wherein the spiral feeding device comprises a cylindrical shell and a spiral propeller inside the cylindrical shell; and the cylindrical shell has a front upper portion provided with an opening for receiving stems and a rear lower portion provided with an opening for conveying the stems into the roller.

6. The stem screening and conditioning device according to claim 1, wherein the blowing tube is provided above an axis of the roller and close to an inner wall of the roller, and the blowing tube has an upper end surface provided with multiple evenly distributed compressed-air nozzles.

7. The stem screening and conditioning device according to claim 1, wherein the steam tube has a lower end surface provided with multiple evenly distributed steam nozzles.

8. The stem screening and conditioning device according to claim 1, wherein the roller has a length of 6 m-12 m.

9. The stem screening and conditioning device according to claim 1, wherein the screen holes have a diameter of 3.8 mm and a spacing of 45 mm.

10. A stem screening and conditioning method for the stem screening and conditioning device according to claim 1, comprising the following steps:

turning on the stem screening and conditioning device; rotating the roller around the axial direction; feeding, by the spiral feeding device, stems into the roller; spraying, by the steam tube, a steam onto the stems in the roller; allowing normal-size stems to be conveyed forward by an inner spiral blade and multiple lifting blades and to be lifted by the multiple lifting blades for a fully contact with the steam, and being transferred to a rear end of the roller and discharged from the discharge hole to complete a conditioning; allowing undersized stems to pass the screen holes of the roller, enter a gap between an outer wall of the roller and an inner wall of the thermal insulation cover, be conveyed forward under a push action of an outer spiral blade, and be discharged from the waste hole; and after completing a screening and the conditioning of the stems, blowing the screen holes in an inner wall of the roller by compressed-air nozzles of the blowing tube for a real-time cleaning to ensure the screen holes are smooth.

11. The stem screening and conditioning method according to claim 10, wherein in the stem screening and conditioning device, the inner wall of the roller is provided with the inner spiral blade in the axial direction.

12. The stem screening and conditioning method according to claim 10, wherein in the stem screening and conditioning device, the inner wall of the roller is provided with the multiple lifting blades, and the multiple lifting blades are arranged in the axial direction and perpendicular to the inner wall of the roller.

13. The stem screening and conditioning method according to claim 10, wherein in the stem screening and conditioning device, the outer wall of the roller is provided with the outer spiral blade in the axial direction, and the outer spiral blade is perpendicular to the outer wall of the roller; and a width of the outer spiral blade is roughly equal to a length of the gap between the outer wall of the roller and the inner wall of the thermal insulation cover.

14. The stem screening and conditioning method according to claim 10, wherein in the stem screening and conditioning device, the spiral feeding device comprises a cylindrical shell and a spiral propeller inside the cylindrical shell; and the cylindrical shell has a front upper portion provided with an opening for receiving the stems and a rear lower portion provided with an opening for conveying the stems into the roller.

15. The stem screening and conditioning method according to claim 10, wherein in the stem screening and conditioning device, the blowing tube is provided above an axis of the roller and close to the inner wall of the roller, and the blowing tube has an upper end surface provided with multiple evenly distributed compressed-air nozzles.

16. The stem screening and conditioning method according to claim 10, wherein in the stem screening and conditioning device, the steam tube has a lower end surface provided with multiple evenly distributed steam nozzles.

17. The stem screening and conditioning method according to claim 10, wherein in the stem screening and conditioning device, the roller has a length of 6 m-12 m.

18. The stem screening and conditioning method according to claim 10, wherein in the stem screening and conditioning device, the screen holes have a diameter of 3.8 mm and a spacing of 45 mm.

* * * * *